United States Patent [19]

Kohne

[11] 4,034,439

[45] July 12, 1977

[54] TRAVERSE ROD FOR DECORATIONS, IN PARTICULAR FOR CURTAINS

[76] Inventor: Franz Köhne, 4 Bahnhofstrasse, Fleckenberg, Sauerland, Germany, 5944

[21] Appl. No.: 639,233

[22] Filed: Dec. 10, 1975

[30] Foreign Application Priority Data

Apr. 16, 1975 Germany ..... 2516645

[51] Int. Cl.[2] ..... A47H 1/04

[52] U.S. Cl. ..... 16/96 R; 160/345

[58] Field of Search ..... 16/93 D, 94 D, 95 D, 16/96 R, 94 R, 87.2, 87.4 R, 93 R, 95 R, 96 D; 160/345

[56] References Cited

U.S. PATENT DOCUMENTS

| | | | |
|---|---|---|---|
| 2,683,891 | 7/1954 | Rosenbaum | 16/93 D |
| 3,424,225 | 1/1969 | Magnusson | 16/95 D |
| 3,698,035 | 10/1972 | Salzmann | 16/95 D |
| 3,818,543 | 6/1974 | Baker | 16/94 D |
| 3,871,082 | 3/1975 | Pflum | 16/93 D |
| 3,927,437 | 12/1975 | Ford | 16/94 R |

FOREIGN PATENT DOCUMENTS

| | | | |
|---|---|---|---|
| 672,110 | 10/1963 | Canada | 16/87.4 R |
| 178,487 | 10/1935 | Switzerland | 16/87.6 R |

*Primary Examiner*—George H. Krizmanich
*Attorney, Agent, or Firm*—Andrus, Sceales, Starke & Sawall

[57] ABSTRACT

A traverse rod for curtains has a plurality of walls forming a hollow box-like cross section. One of the walls contains an opening for receiving slides or rollers attachable to the curtains. An adjacent wall contains a C-shaped recess and a U-shaped recess. These recesses may be used to receive curtain slides or rollers and/or to mount the traverse rod in its various orientations. The wall opposite the wall containing the recesses has a projection depending therefrom which may be used as a contact surface for the slides or rollers in certain orientations of the traverse rod.

5 Claims, 8 Drawing Figures

FIG. 2
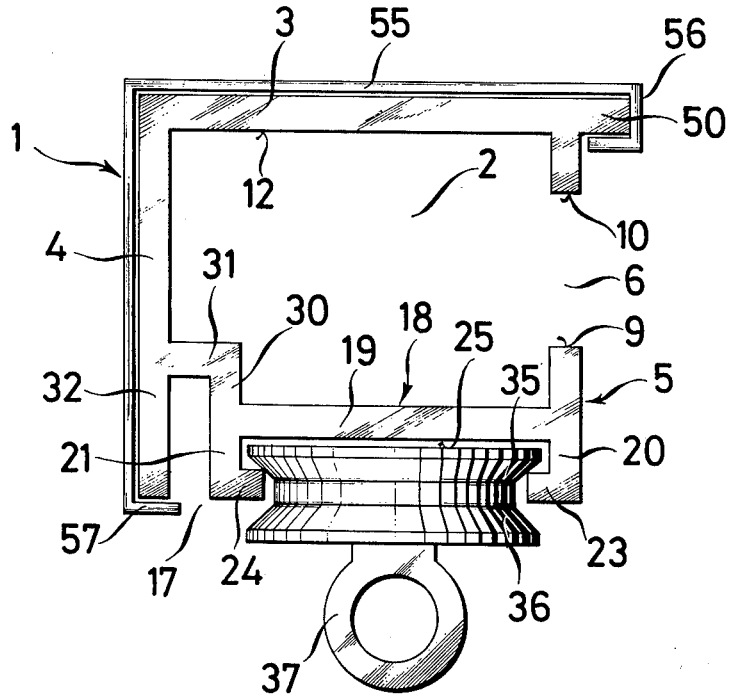
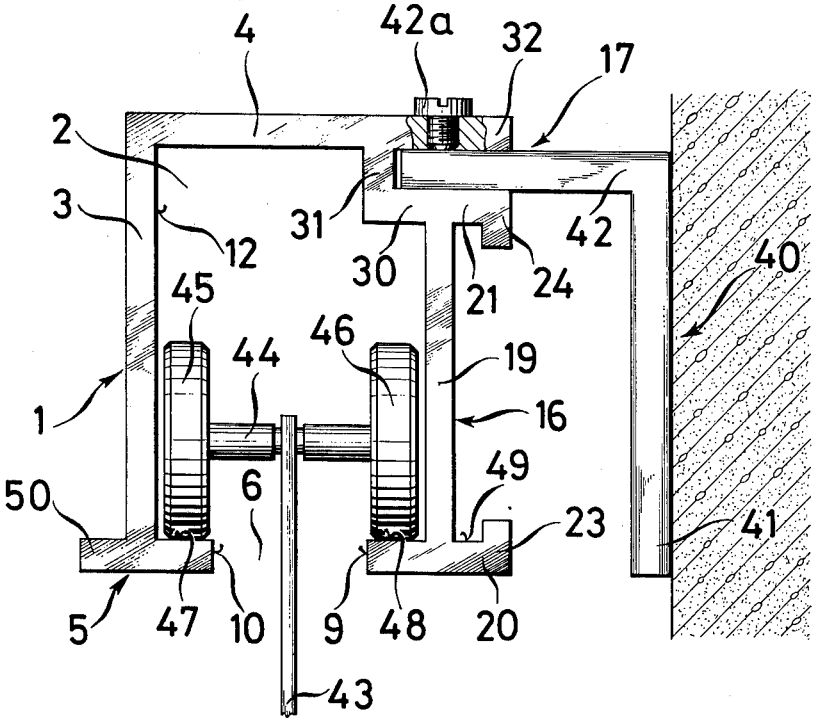
FIG. 3

FIG. 4
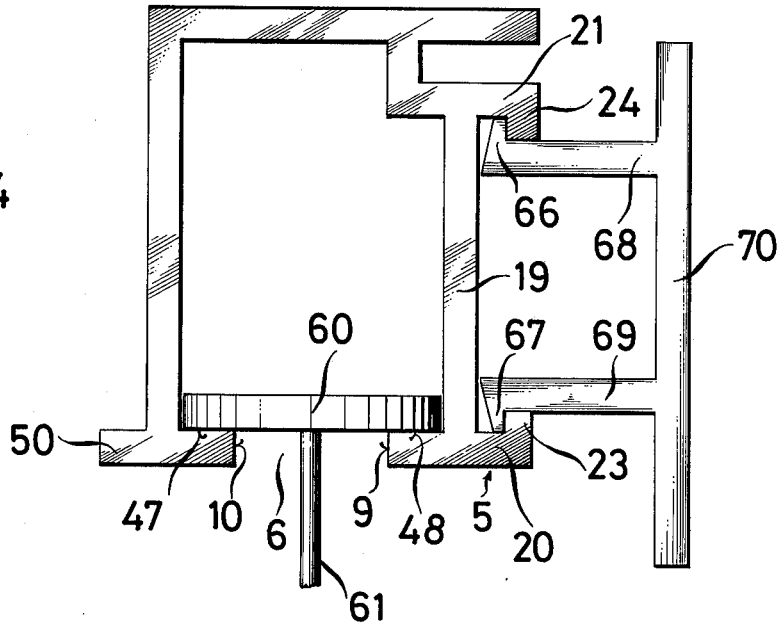
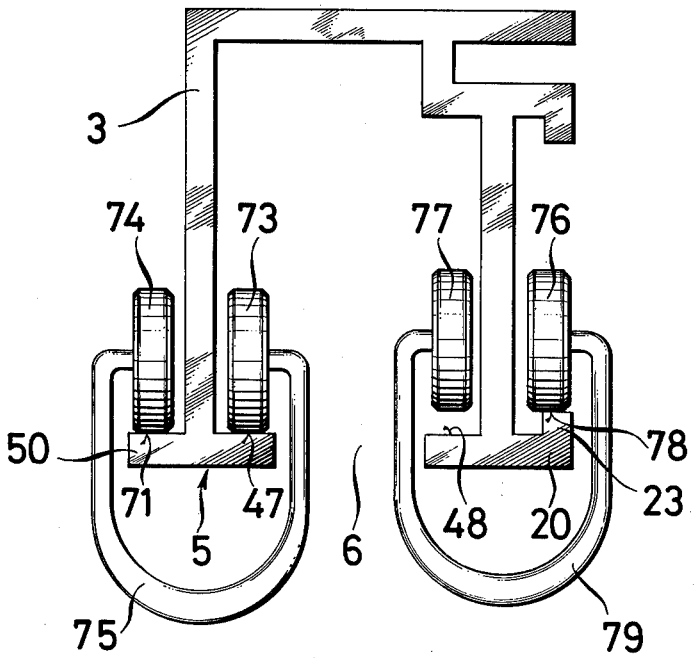
FIG. 5

TRAVERSE ROD FOR DECORATIONS, IN PARTICULAR FOR CURTAINS

BACKGROUND OF THE INVENTION

1. Field of the Invention

The present invention is directed to a traverse rod for decorations, such as curtains, vertical jalousies and movable wall portions.

2. Background and Summary of the Present Invention

The arrangement of previously known traverse rods (see German Gebrauchmuster 1,943,054) permits only the use of so-called T-rollers or slides. While the T-rollers or slides do exist in a number of embodiments, they are generally limited to a configuration in which the decoration holding hook or clamp is confined between two rollers.

However, in addition to T-rollers and slides, U-shaped rollers or slides are also available in which the rollers or slides are located on the arms of a fork which carries the decoration or mounting means therefore. Still further, there are C-formed slides which may, in plan view, be ring-formed.

In the past, different traverse rod configurations were required to accommodate these different types of slides or rollers since a given mounting means can only be employed with a given traverse rod configuration. Further, a variety of sizes of each of the different configurations of traverse rods were also necessary.

The resulting disadvantages are numerous. The decorator is required to have available, with considerable effort and at high cost, a large number of different traverse rod configurations. The customer is frequently limited in choice to that which the decorator has in stock so that many decorating problems remain unsolved.

It is, therefore, the object of the present invention to obviate the foregoing difficulties and provide a traverse rod which is so formed as to permit use with a wide variety of different types of rollers or slides and which may be mounted in a variety of orientations.

The present invention contemplates a traverse rod having a plurality of walls forming a box-like hollow cross section. One of the walls of the box section contains an opening through which slides or rollers may be received within the box section.

A box wall adjacent the box wall containing the opening includes a pair of arms which form a C-shaped recess on the exterior of the rod. One of the arms additionally forms a U-shaped recess adjacent the C-shaped recess. The portion of the box wall opposite the wall containing the opening completes the U-shaped recess.

The opening in the one box wall permits the use of C-rollers and slides of various types. It also permits the use of one or more U-rollers. The C-shaped recess also permits the use of a variety of mounting means including ring-slides and C-slides. T-rollers may also be used with the improved traverse rod of the present invention.

The U-shaped recess serves as a mounting means for the traverse rod in its various orientations.

The traverse rod of the present invention is so formed that with the use of the slides or rollers in its various orientations about its longitudinal axis, not only one, but all sides of the traverse rod, may serve as contact surfaces for the mounting means for the decorations.

To increase the stability of the rail, especially with decorations which have a corresponding high weight, the U-shaped recess is provided with a flat web at the bottom which is located within the hollow interior of the box section and which extends parallel to the surface containing the C-shaped recess and U-shaped recess.

Preferably, the arms of the C and U-shaped recesses are the same thickness as the box walls of the traverse rod.

In another embodiment of the invention, a projection depends from the box wall lying opposite the wall containing the C and U-shaped recesses. This projection may serve as a contact surface for the slides or rollers in certain orientations of the traverse rod.

BRIEF DESCRIPTION OF THE DRAWING

The details and other features and advantages of the present invention will be apparent from the following description and the drawing which describe and show the construction of the present invention and the various ways in which it may be employed.

FIG. 2 is a view similar to FIG. 1 showing a different orientation of the traverse rod and the use of ring-like slides.

FIG. 3 is a view similar to FIGS. 1 and 2 showing yet another orientation of the traverse rod of the present invention and the use of T-rollers.

FIG. 4 is a view similar to FIG. 3 showing the use of C-slides and a covering molding.

FIG. 5 is a view similar to FIGS. 3 and 4 showing the provision of two parallel rails for U-rollers.

DESCRIPTION OF THE PREFERRED EMBODIMENT

Figure 1:
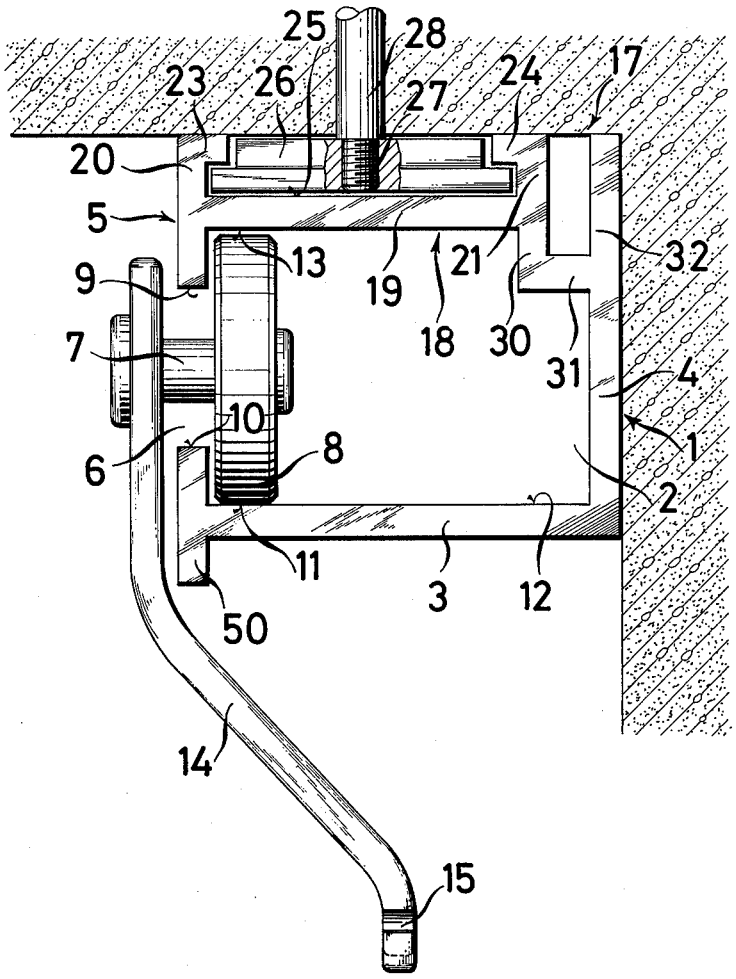
FIG. 1 is an elevational view of the traverse rod of the present invention showing the use of C-rollers.

As shown in FIG. 1, the traverse rod 1 of the present invention includes walls 3, 4, 5, and 18 formed into a hollow box-like cross section. The hollow space within the box is identified with the numeral 2.

Box wall 5 has an opening or slit 6 running in the longitudinal direction of traverse rod 1 through which a C-roller curtain hanger may be received in the hollow space 2 of traverse rod 1. Roller 8 of the curtain hanger is positioned on axle 7 which carries arm 14. Hole 15 is provided in arm 14 for the customary fold-pleater, not shown. The surfaces 9 and 10 of opening 6 serve to guide C-roller along contact surface 11 on the inner side 12 of box wall 3 and contact surface 13 on the inner side of box wall 18. Surface 13 lying opposite surface 11 comes into effect in the event of a lifting of roller 8.

Arms 20 and 21 project from box wall 18 which is adjacent box wall 5 containing opening 6. Arms 20 and 21 contain flanges 23 and 24, respectively so as to form with base 19 of wall 18 a generally C-shaped recess 16 on the exterior of rod 1. Outer arm 20 is in alignment with box wall 5 containing opening 6 so as to present a generally flush exterior surface. Inner arm 21, in addition to forming a portion of C-shaped recess 16, forms an arm of U-shaped recess 17 in the exterior of rod 1 adjacent C-shaped recess 16. The other arm of U-shaped recess 17 is formed of portion 32 of box wall 4 which lies opposite box wall 5.

In the typical embodiment of traverse rod 1 shown in the Figures, the U-shaped recess 17 is completed by a flat web 31 positioned on wall 4 on the inside 2 of rod 1, parallel to box wall 18. As shown in FIG. 1, U-shaped recess 17 is completed by extension 30 between inner arm 21 and web 31 so that web 31 may be positioned in approximate alignment with surface 9 of opening 6. The arms of the C and the U-shaped recesses customarily exhibit the same thickness as the walls of rod 1.

Box wall 3, which lies opposite box wall 18 containing adjacent C and U-shaped recesses 16 and 17, has depending projection 50 which is aligned with box wall 5 containing opening 6 and used for purposes hereinafter described.

Plates 26 are inserted in the C-shaped recess 16 and between flanges 23 and 24 of arms 20 and 21 and contiguous with the outer surface 25 of box wall 18. Plates 26 are provided with a threaded bore 27 so that an appropriately threaded portion of a suspender 28 for the traverse rod may be received. This arrangement has the advantage that the mounting means 26–28 need not be threaded on traverse rod 1. Additionally, the rod may be freely suspended if necessary or desired, for example, in connection with the decoration of vents, cabins, or the like. Plates 26 may also receive cords or lines suitable for raising traverse rod 1 into position.

FIGS. 2 through 8 disclose additional embodiments and uses of the traverse rod of the present invention, similar parts being identified by the same numbers used in connection with the embodiment of FIG. 1.

In the embodiment of FIG. 2, flanges 23 and 24 of the C-shaped recess 16 are utilized to guide ring-formed slides. These slides are located with their upper flanges 35 adjacent the outer surface 25 of the base 19 of the C-shaped recess 16 but behind flanges 23 and 24. The exterior surfaces of flanges 23 and 24 lie opposite the second flange 36 of the slide. The slide contains an eye 37 to which further mounting means for the decorations can be connected.

The mounting of traverse rod 1 in the orientation shown in FIG. 2 may be accomplished by the use of sheet 55 having portion 56 which embraces projection 50 on box wall 3 and having edge 57 which supports arm 32 of box wall 4.

In the exemplary embodiment shown in FIG. 3, traverse rod 1 is oriented so that U-shaped recess 17 may be employed in conjunction with support rails 40 to position the traverse rod. Support rail 40 is angular in cross section, having longer arm 41 which is fastened on a wall, as for example, by not here disclosed screws. Support rail 40 also has a shorter arm 42 which may be inserted in U-shaped profile 17 between arms 32 and 21 and extension 30. Arm 42 is fixed in U-shaped profile 17 with screw 42*a*.

The opening 6 in box wall 5 receives shaft 43 for decoration hooks, not shown. Shaft 43 is joined to axle 44 of double T roliers 45 and 46 which roll on surfaces 47 and 48.

In the embodiment shown in FIG. 4, slide 60 is employed. Slide 60 includes shaft 61 of a hook, not shown. Slide 60 engages contact surfaces 47 and 48 on the inner side of box wall 5 containing opening 6.

Convering molding 70 includes arms 68 and 69, containing projections 66 and 67, respectively. These projections may be snapped between arms 21 and 22 and flanges 23 and 24, respectively, to secure the molding in C-shaped profile 16.

In the embodiment according to FIG. 5, contact surface 47 on the inner side of wall 5 adjacent opening 6 and a further contact surface 71 on projection 50 of wall 3 are provided for rollers 73 and 74 of a U-roller containing hanger 75. Corresponding U-rollers 76 and 77 containing hanger 79 engage contact surface 78 on the inner side of flange 23 and contact surface 48 on the other side of wall 5 adjacent opening 6.

Figure 6:
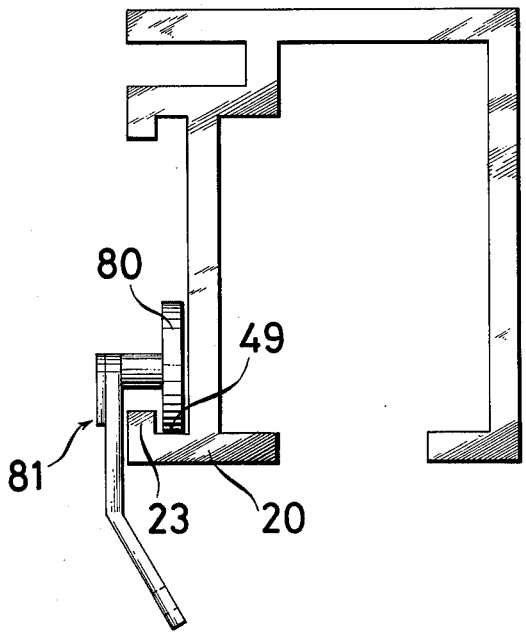
FIG. 6 is an elevational view of a second embodiment of the traverse rod of the present invention showing use of the rod with C-slides.

In the embodiment of the invention shown in FIG. 6, the rail 80 of a C-slide 81 slides on the contact surface 49 on the inner surface of the arm 20 of C-shaped recess and is retained in the channel so formed by flange 23.

Figure 7:
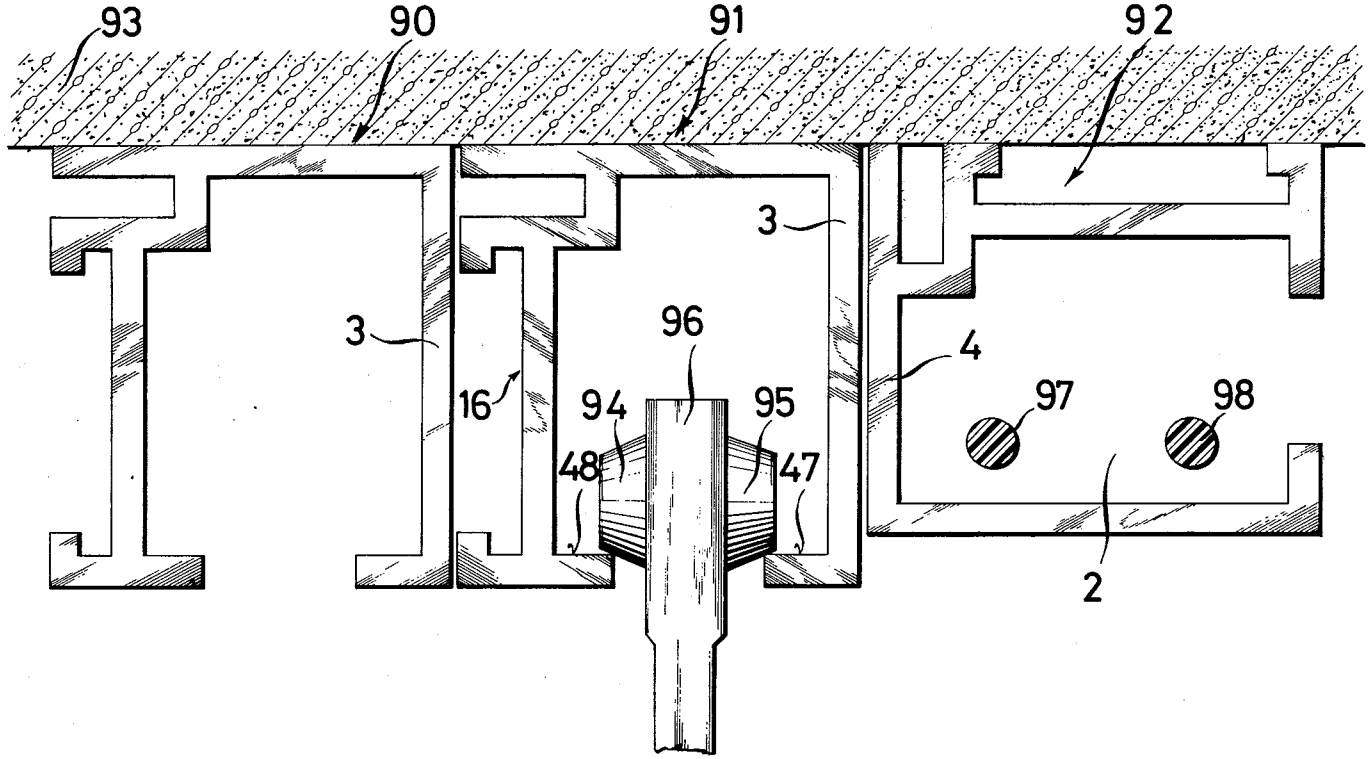
FIG. 7 is an elevational view of a plurality of the traverse rods shown in FIG. 6 in a parallel arrangement.

FIG. 7 shows a plurality of traverse rods 1 of the type shown in FIG. 6 in a side by side configuration. The embodiment of the invention shown in FIG. 6 does not have projection 50 depending from box wall 3. Three traverse rods 90, 91 and 92 are shown in FIG. 7 as fastened to the ceiling by not here disclosed means. Traverse rod 91 is oriented so that contact surfaces 47 and 48 are provided for rollers 94 and 95 of T-formed hanger 96. Whereas rods 90 and 91 are fastened on ceiling 93 so that box wall 3 of traverse rod 90 is opposite C-shaped recess 16 of adjacent traverse rod 91, traverse rod 92 is rotated 90° so that box wall 4 of traverse rod 92 is opposite box wall 3 of traverse rod 91. This allows draw strings 97 and 98 to be accommodated in the inside 2 of traverse rod 92. The hanger accommodated in traverse rod 90 is not shown.

Figure 8:
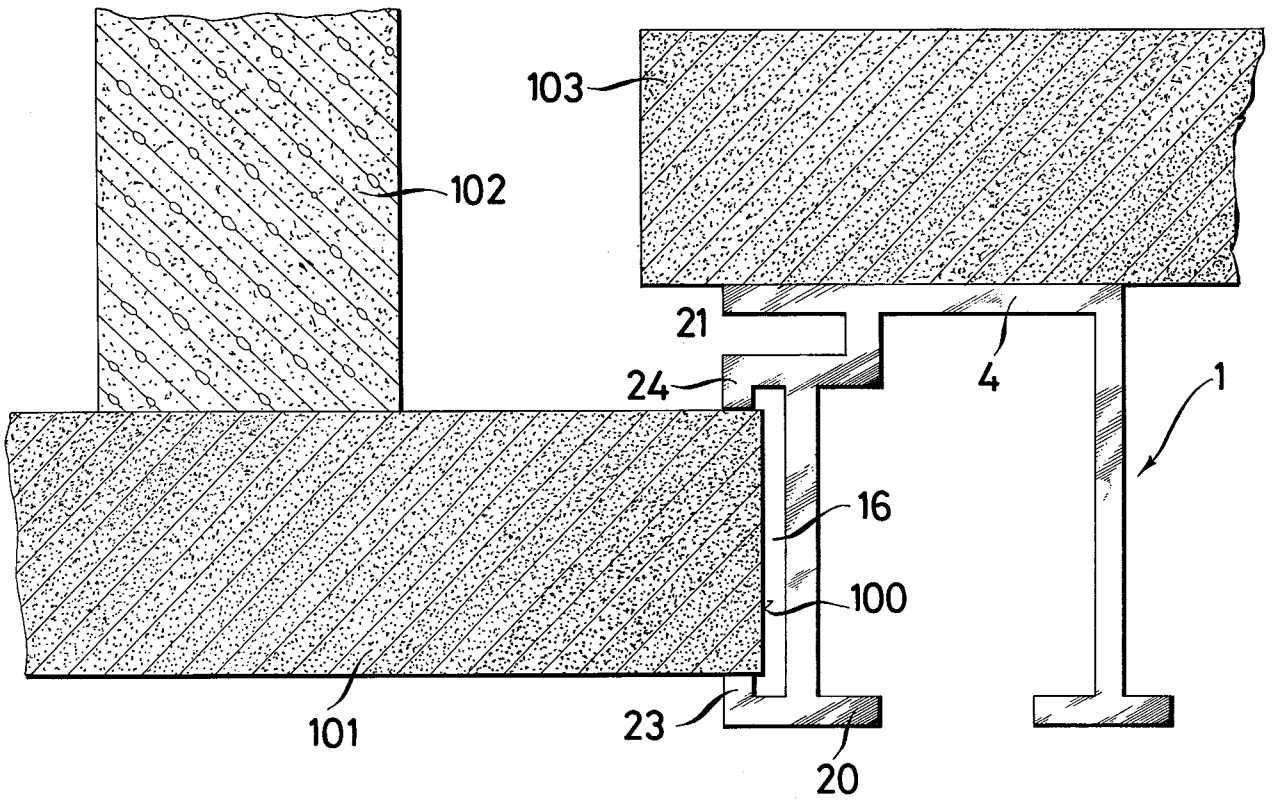
FIG. 8 is a view showing the traverse rod of the present invention in a further mounting arrangement.

FIG. 8 shows how C-shaped recess 16 may fasten traverse rod 16 on the forward edge 100 of plaster sheet 101 suspended by member 102. The flanges 23 and 24 of arms 21 and 20, respectively, of the C-shaped recess 16 embrace the edge 100 of plaster sheet 101. Further, box wall 4 of traverse rod 1 may be fastened to an additional plaster sheet 103.

It will be appreciated that further attachment possibility exists for traverse rod 1 and that additional types of suspenders or hangers for decorations may be employed in conjunction with the traverse rod.

Various modes of carrying out the invention are contemplated as being within the scope of the following claims particularly pointing out and distinctly claiming the subject matter which is regarded as the invention.

I claim:

1. A traverse rod mountable on a building element by a variety of different types of mounting means for receiving hanger means for decorations, in particular, curtains, said hanger means being movable along said traverse rod for moving said decorations with respect to said building element, said traverse rod being suitable for use with a variety of different types of hanger means and in a variety of positions, said rod comprising:

a plurality of elongated walls joined to form a generally box-like hollow cross section for the rod having an axis of elongation normal to the cross section, said rod being orientable about the axis of elongation in a variety of positions with respect to the building element;

a first of said walls having an elongated opening (6) therein for receiving and movably retaining a variety of different types of hanger means for hanging the decorations;

a second of said walls (4) opposite said first wall having a portion (32) contiguous in a direction normal to the axis of elongation; and a third of said walls (18) adjacent said first wall having a pair of outwardly extending arms (20,21), a lip on each of said arms extending toward each other for forming a C-shaped recess (16) opening on the exterior of said third wall suitable for receiving a variety of different types of types of mounting means and hanger means, and for movably retaining the latter, one of said arms (21) being parallel to, but spaced from, said portion (32) and forming with said portion (32) a second recess (17) opening on the exterior of said third wall adjacent to said C-shaped recess, a web (31) lying within the hollow box-like hollow cross section of said rod and parallel to said third wall (18) for coaction with said one arm (21) and said third wall portion (32) for closing the bottom of said second recess (17) within said box-like hollow cross section, said second recess being suitable for receiving a mounting means for said rod.

2. The traverse rod according to claim 1 further defined in that the other of said arms (20) forming said C-shaped recess (16) is in alignment with said first wall to present a generally flush exterior surface.

3. The traverse rod according to claim 1 wherein said plurality of walls further includes a fourth wall (3) lying opposite said second side wall and having a lip (50) depending therefrom.

4. A traverse rod according to claim 1 wherein said side walls and said arms are similar in thickness.

5. The traverse rod according to claim 3 wherein said walls, said arms, and said lip are similar in thickness.

* * * * *